US010711546B2

(12) United States Patent
Turner et al.

(10) Patent No.: US 10,711,546 B2
(45) Date of Patent: Jul. 14, 2020

(54) METHODS FOR OPERATING WELLBORE DRILLING EQUIPMENT BASED ON WELLBORE CONDITIONS

(71) Applicant: National Oilwell Varco, L.P., Houston, TX (US)

(72) Inventors: Rebekah Turner, Houston, TX (US); Daniel M. Veeningen, Houston, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 219 days.

(21) Appl. No.: 15/312,411

(22) PCT Filed: May 12, 2015

(86) PCT No.: PCT/US2015/030335

§ 371 (c)(1),
(2) Date: Nov. 18, 2016

(87) PCT Pub. No.: WO2015/175508

PCT Pub. Date: Nov. 19, 2015

(65) Prior Publication Data

US 2017/0122047 A1 May 4, 2017

Related U.S. Application Data

(60) Provisional application No. 61/991,989, filed on May 12, 2014.

(51) Int. Cl.

| | |
|---|---|
| ***E21B 21/08*** | (2006.01) |
| ***E21B 47/06*** | (2012.01) |
| ***E21B 19/16*** | (2006.01) |
| *E21B 47/12* | (2012.01) |

(52) U.S. Cl.
CPC ..... *E21B 21/08* (2013.01); *E21B 19/16* (2013.01); *E21B 47/06* (2013.01); *E21B 47/12* (2013.01)

(58) Field of Classification Search
CPC ..... E21B 21/08; E21B 47/06
See application file for complete search history.

(56) References Cited

U.S. PATENT DOCUMENTS

| | | | | |
|---|---|---|---|---|
| 6,021,377 A * | 2/2000 | Dubinsky | E21B 7/068 702/9 |
| 6,220,087 B1 | 4/2001 | Hache et al. | |
| 6,659,197 B2 * | 12/2003 | Cooper | E21B 49/003 166/250.01 |
| 7,251,566 B2 * | 7/2007 | Wu | G01V 1/46 702/6 |

(Continued)

FOREIGN PATENT DOCUMENTS

WO 03071091 A1 8/2003

*Primary Examiner* — Shane Bomar
(74) *Attorney, Agent, or Firm* — Porter Hedges LLP; Jonathan Pierce; Pierre Campanac

(57) ABSTRACT

A method, comprising acquiring annular pressure data from a wellbore where the annular pressure data is acquired over a time interval and at least a portion of the annular pressure data is acquired during a pumps-off period. At least first and second values are identified from the annular pressure data and the variation between the first and second values are compared to a first threshold. Drilling equipment is operated based on the comparison with the first threshold.

20 Claims, 10 Drawing Sheets

(56) References Cited

U.S. PATENT DOCUMENTS

| | | | | |
|---|---|---|---|---|
| 7,490,028 | B2 * | 2/2009 | Sayers | E21B 21/08 166/255.1 |
| 8,527,249 | B2 | 9/2013 | Jamison et al. | |
| 2003/0102163 | A1 | 6/2003 | Hemphill | |
| 2005/0087367 | A1 | 4/2005 | Hutchinson | |
| 2009/0063055 | A1 * | 3/2009 | Schneider | E21B 21/08 702/9 |
| 2009/0190850 | A1 * | 7/2009 | Tang | G01V 11/00 382/251 |
| 2009/0294174 | A1 | 12/2009 | Harmer et al. | |
| 2015/0330168 | A1 * | 11/2015 | Sun | E21B 47/06 700/282 |

* cited by examiner

METHODS FOR OPERATING WELLBORE DRILLING EQUIPMENT BASED ON WELLBORE CONDITIONS

BACKGROUND

Down-hole annular pressure is a well-known measurement in the technology area of wellbore drilling. Down-hole annular pressure data may be used to identify undesirable drilling conditions, suggest remedial procedures, and prevent serious problems from developing. For example, with accurate annular pressure data in real-time, drillers can apply conventional drilling practices more effectively to potentially reduce both rig time and the number of casing strings. In particular, SPE publication No. 49114 discusses how, with real-time down-hole annular pressure while drilling ("APWD") measurements, drillers can more effectively maintain the equivalent circulating density ("ECD") and equivalent static density ("ESD") within a desired range in order to prevent lost circulation and maintain wellbore integrity by managing swab, surge and gel breakdown effects.

However, it may not be always possible to provide real-time down-hole APWD measurements to drillers, in particular during pipe connections when the drilling fluid circulation pumps are turned off (a "pumps-off" condition). Instead, Canadian patent No. 2,298,859 discloses a method that provides near real-time advantage of APWD measurements taken during pipe connections. APWD data are measured, stored and even processed in the bottom-hole assembly during a pumps-off condition for subsequent communication of a reduced amount of data to drillers at the surface. More recently, wired drill pipe ("WDP") technology has been offering along-string APWD measurements in real-time. For example, the industry report published on the September 2011 issue of World Oil describes a well drilling operation where battery-powered tools were connected down-hole to a WDP network to continuously transmit down-hole APWD data even when no circulation was present. In this example, an integrated managed pressure system allowed drillers to instantaneously and continuously control circulating pressure within a 30-psi window while drilling, and to control pressure changes within a 100-psi window during drill pipe connections.

The full benefits of APWD data availability in real-time may not have been achieved yet because drillers still rely on approximative rules for operating drilling equipment and control the variations of APWD. These rules, while having possibly wide application, may not be intended to be strictly accurate or reliable in every situation. Typically, these rules yield to operations of wellbore drilling equipment that are too conservative and less economical. However, in some cases, these rules may be too aggressive, and excessive drilling rate of penetration ("ROP") may compromise wellbore stability or excessive speed of the drill string may generate flow of formation fluid into the wellbore during tripping operations such as when tripping out of the hole.

SUMMARY

Those skilled in the art will readily recognize that the present disclosure and its accompanying figures introduce methods of operating wellbore drilling equipment. Annular pressure data are measured at a location along a wellbore during a time interval including a pumps-off period around a drill pipe connection. The annular pressure data may comprise equivalent densities or normalized equivalent densities. While additional values may be identified from the annular pressure data measured during pumps-on periods, at least first and second values are identified from the annular pressure data measured during the pumps-off period, wherein the first value is identified prior to making the drill pipe connection and the second value is identified after making the drill pipe connection. The variation between first and second values is compared to a threshold. A drilling fluid circulation pump is operated based on the comparison with the threshold for maintaining subsequent variations of annular pressure in a desired range. For example, a pumping rate or a pumping duration may be determined based on the comparison; and the drilling fluid circulation pump may be operated at the determined pumping rate or for the determined pumping duration during a pump ramp-up or slow-down period subsequent the drill pipe connection. The threshold may be determined using a statistical analysis of values of the variation between annular pressure data before and after drill pipe connections. The analysis may comprise extrapolating a trend with time or wellbore length. Or the threshold may be determined using a fluid circulation model of the wellbore.

A method, comprising acquiring annular pressure data from a wellbore where the annular pressure data is acquired over a time interval and at least a portion of the annular pressure data is acquired during a pumps-off period. At least first and second values are identified from the annular pressure data and the variation between the first and second values are compared to a first threshold. Drilling equipment is operated based on the comparison with the first threshold.

In some embodiments, a method comprises acquiring annular pressure data from a wellbore, wherein the annular pressure data is acquired over a time interval and at least a portion of the annular pressure data is acquired during a pumps-off period. Equivalent densities are then computed based upon the acquired annular pressure data. A first threshold is determined by correlating the equivalent densities to drilling efficiency, wherein the first threshold is indicative of uneconomical performance. A second threshold is determined by correlating the equivalent densities to drilling efficiency, wherein the second threshold is indicative of high performance. Annular pressure data is measured within the wellbore and at least first and second values are identified from the measured annular pressure data. The variation between the first and second values are compared to the first threshold and the second threshold and drilling equipment is operated based on the comparison with the first threshold and the second threshold.

In some embodiments, a method comprises determining an equivalent density of a drilling fluid at a plurality of locations within a wellbore and correlating the equivalent densities to drilling efficiency so as to determine a first threshold. Annular pressure data is acquired from a location within the wellbore, wherein the annular pressure data is acquired over a time interval and at least a portion of the annular pressure data is acquired during a pumps-off period. At least first and second values are identified from the annular pressure data and the variation between first and second values is compared to the first threshold. Drilling equipment is operated based on the comparison with the first threshold.

The annular pressure data may be measured at a first location, and the method may further comprise measuring annular pressure data at other locations along the wellbore different from the first location. In these cases, the drilling fluid circulation pump may further be operated based on the annular pressure data measured at the other locations.

The method may further comprise transmitting the measured annular pressure data via wired drill pipe telemetry, and displaying the variation between first and second values and the threshold on a visualization dial. Alternatively, or additionally, the method may further comprise displaying the variation between first and second values on a log including indications of drilling conditions. The indications of drilling conditions may comprise at least one of mud type, formation type, wellbore inclination and rig crew tours.

In some embodiments, operating the drilling fluid circulation pump based on the comparison may comprise cleaning-up the wellbore prior to the subsequent drill pipe connection for a duration that is shorter than the duration used prior to the current drill pipe connection when the variation between first and second values is greater than the threshold, or at least as long as the duration used prior to the current drill pipe connection when the variation between first and second values is not smaller than the threshold.

In some embodiments, operating the drilling fluid circulation pump based on the comparison may comprise cleaning-up the wellbore prior to the subsequent drill pipe connection for a duration that is longer than the duration used prior to the current drill pipe connection when the variation between first and second values is less than the threshold, or at most as short as the duration used prior to the current drill pipe connection when the variation between first and second values is not larger than the threshold.

In some embodiments, the time interval during which annular pressure data are measured may also comprise a clean-up period and a pump ramp-up or slow-down period, and the method may further comprise identifying a third value from the annular pressure data measured during the clean-up period, and a fourth value from the annular pressure data measured during the pump ramp-up or slow-down period. The rate or the duration of operation of the drilling fluid circulation pump during a pump ramp-up or slow-down period subsequent to the drill pipe connection may be changed based on the variation between third and fourth values, and/or the variation between second and fourth values.

In some embodiments, the time interval during which annular pressure data are measured may also comprise a drilling period and a clean-up period, and the method may further comprise identifying a third value from the annular pressure data measured during the drilling period and a fourth value from the annular pressure data measured during the clean-up period. One of a circulation flow rate, weight on bit and string rotation speed during a drilling period subsequent the connection may be changed based on the variation between third and fourth values, and/or the variation between second and fourth values.

Alternatively or additionally, a pressure data value is identified while setting drill string in slips, or while picking up drill string off slips. At least one of a relative pressure change and a pressure change rate is determined from the identified value, and is compared to a threshold. At least one of speed and acceleration of a traveling block or other hoisting equipment is controlled based on the comparison.

DRAWINGS

The present disclosure is best understood from the following detailed description when read with the accompanying figures.

DESCRIPTION

Figure 1:
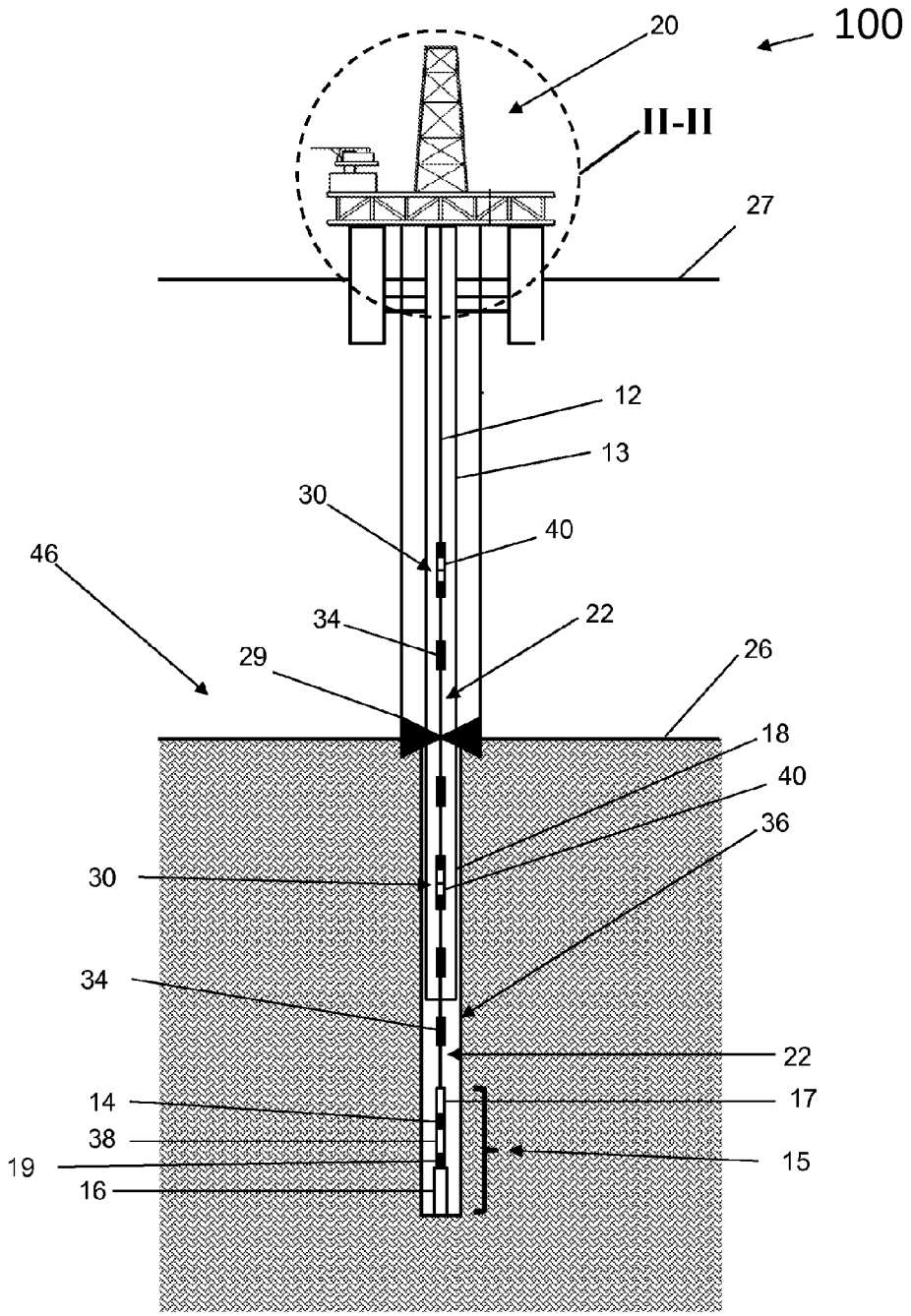
FIG. 1 is a schematic of a drilling rig and data transmission system suitable for acquiring annular pressure data.

It is to be understood that the following disclosure provides many different examples for implementing different features of various embodiments. Specific examples of components and arrangements are described below to simplify the present disclosure. These are, of course, merely examples and are not intended to be limiting. In addition, the example methods and flow charts described in the embodiments presented in the description that follows may include embodiments in which certain steps may be performed in a different order, in parallel with one another, omitted entirely, regrouped and renamed, and/or combined between different example methods, and/or certain additional steps can be performed, without departing from the scope of the disclosure.

This disclosure describes methods to determine indices of aggressiveness and/or conservativeness based on equivalent drilling fluid densities (e.g., down-hole ESD or ECD) measured around drill pipe connections. On the one hand, these indices may provide insight and quantify risks otherwise not known. On the other hand, these indices may measure drilling performance, where low performance is uneconomical or suboptimal. Thus, these values may help balancing operation performance with risks. The indices of aggressiveness and/or conservativeness may be used for comparing drilling operations between different drillers, between different sections of a single wellbore or between different wellbores located in a geographical area of interest.

The indices of aggressiveness and/or conservativeness may be computed from wellbore pressure data indicative of 1) drilling periods to take into account increased cutting content in the drilling fluid, 2) clean-up periods to take into account decreased cutting content in the drilling fluid during sweeps or during circulation without drilling, 3) pump ramp-up or slow-down periods to take into account the impact of flow rate increase on wellbore pressure, as well as 4) pumps-off periods to take into account the settling of cuttings. In addition, pressures caused by acceleration of the drill string while setting the drill string in slips or picking up the drill string off slips, or caused by swab and surge effects during tripping may also be used.

The indices of aggressiveness and/or conservativeness may be determined down-hole and be transmitted to surface via mud pulse telemetry when the flow rate of drilling fluid is sufficient for mud pulsers to operate. The transmission of indices corresponding to operations performed when the flow rate of drilling fluid is insufficient for mud pulsers to operate may be delayed until the flow rate of drilling fluid becomes sufficient, and is not considered to be in real-time. Thus, wired drill pipe ("WDP") technology is well suited to implement certain aspects of this disclosure. The values may be displayed to aid well site operations, and/or may be used for automated optimization of drilling and tripping. Also, wellbore drilling equipment may be controlled and drilling be optimized by using estimates of the aggressiveness and/or conservativeness of the drilling operations that are computed in real-time from down-hole measurements.

FIG. 1 illustrates a schematic view of a drilling operation 100 in which a wellbore 36 is being drilled through a subsurface formation beneath the ocean or sea floor 26. The drilling operation 100 includes a drilling rig 20 on the ocean surface 27 and a drill string 12 which extends from the rig 20, through a riser 13 in the ocean water, through a BOP 29, and into the wellbore 36 which is further reinforced with a casing pipe 18 for at least some distance below the sea floor 26. An annulus 22 is formed between the outer surface of the drill string 12 and the inner surface of the riser 13, casing 18, and wellbore 36. BOP 29 is configured to controllably seal the wellbore 36. A bottom hole assembly 15 ("BHA") is provided at the lower end of the drill string 12. As shown in FIG. 1, BHA 15 includes a drill bit or other cutting device 16, a sensor package 38 located near the bit 16, a formation evaluation package and/or a drilling mechanics evaluation package 19, a directional drilling motor or rotary steerable device 14, and a network ready interface sub 17. However, it should be noted that BHA 15 may include different components while still complying with the principles of the current disclosure.

The drilling rig 20 includes equipment for drilling the wellbore 36. This equipment may include, but is not limited to, drilling fluid circulation pumps for pumping drilling fluid into the bore of the drill string 12, a top drive or rotary table for rotating the drill string 12, and a draw-works and traveling block or other hoisting equipment for suspending the drill string. Further, some equipment for drilling the wellbore 36 may also be provided in conjunction with the BOP 29, and may include, but is not limited to, choke valves, and sealing packers. Still further, some equipment for drilling the wellbore 36 may also be provided in the BHA 15, and may include, but is not limited to, the drilling motor or rotary steerable 14, and circulation subs along the drill string 12. All or part of this equipment may be operated (e.g., controlled, actuated, etc. . . . ) based on indices of aggressiveness and/or conservativeness in accordance with one or more aspects of the present disclosure.

Drill string 12 generally comprises a plurality of tubulars coupled end to end. Connectors or threaded couplings 34 are located at the ends of each tubular thereby facilitating the coupling of each tubular to form drill string 12. In some embodiments, connectors 34 represent wired drill pipe joint connectors. The drill string 12 also preferably includes a plurality of network nodes 30. The nodes 30 are provided at desired intervals along the drill string 12. Network nodes 30 essentially function as signal repeaters to regenerate and/or boost data signals and mitigate signal attenuation as data is transmitted up and down the drill string. The nodes 30 may be integrated into an existing section of drill pipe or a down-hole tool along the drill string 12. Interface sub 17 in BHA 15 may also include a network node (not shown separately). The nodes 30 are a portion of a networked drill string data transmission system 46 that provides an electromagnetic signal path that is used to transmit information along the drill string 12. The data transmission system 46 may also be referred to as a down-hole electromagnetic network, broadband network telemetry, or WDP telemetry and it is understood that the drill string 12 primarily referred to below may be replaced with other conveyance means. Communication links (not shown) may be used to connect the nodes 30 to one another, and may comprise cables or other transmission media integrated directly into sections of the drill string 12. The cable may be routed through the central wellbore of the drill string 12, routed externally to the drill string 12, or mounted within a groove, slot, or passageway in the drill string 12. Induction coils may be placed at each connection 34 to transfer the signal being carried by the cable from one drill pipe section to another. Signals from the plurality of sensors in the BHA 15 (e.g., in sensor packages 38, or 19) and elsewhere along the drill string 12 are transmitted to a well site computer located on or near rig 20 through the data transmission system 46. A plurality of data packets (not shown) may be used to transmit information along the nodes 30. As previously described, nodes 30 may include booster assemblies. In some embodiments, the booster assemblies are spaced at 1,500 ft. (500 m) intervals to boost the data signal as it travels the length of the drill string 12 to prevent signal degradation. Communication links between the nodes 30 may also use wireless connections.

Additionally, sensors 40 disposed on or within network nodes 30, allow measurements to be taken along the length of the drill string 12. For purposes of this disclosure, the term "sensors" is understood to comprise sources (to emit/transmit energy/signals), receivers (to receive/detect energy/signals), and transducers (to operate as either source/receiver). Various types of sensors 40 may be employed along the drill string 12 in various embodiments, including without limitation, axially spaced pressure sensors, temperature sensors, and others. While sensors 40 are herein described and shown disposed on the drill string 12, it should also be noted that sensors 40 may be disposed on any down-hole tubular that has an inner diameter that allows for the passage of flow therethrough while still complying with the principles of the current disclosure. For example, sensors 40 may be disposed on equipment such as, but not limited to, heavy weight drill pipe, drill pipe, drill collars, stabilizers, float subs, reamers, jars, or flow bypass valves. The sensors 40 may also be disposed on the nodes 30 positioned along the drill string 12, disposed on tools incorporated into the string of drill pipe, or a combination thereof. In some embodiments, the sensors 40 measure the conditions (e.g., down-hole annular pressure, temperature) around the bore of the drill string 12 and in the annulus 22. Additionally, in some embodiments, sensors 40 measure the conditions (e.g., pressure, temperature) within the bore of the drill string 12. Although only a few sensors 40 and nodes 30 are shown in the figures referenced herein, those skilled in the art will understand that a larger number of sensors may be disposed along a drill string when drilling a fairly deep well, and that all sensors associated with any particular node may be housed within or annexed to the node 30, so that a variety of sensors rather than a single sensor will be associated with that particular node.

The data transmission system 46 shown in FIG. 1 transmits down-hole annular pressure data measured by sensors in the BHA 15 (e.g., in sensor packages 38, or 19), or by each of a plurality of sensors 40 to the well site computer located on or near rig 20. The pressure data may be similar to the ones shown in the graph of FIG. 2 for example. From the well site computer, the pressure data may be displayed to drillers on a well site screen. The pressure data may also be transmitted from the well site computer to a remote computer (not shown), which is located at a site that is remote from the well site or rig 20. The remote computer allows an individual in a location that is remote from the well site or rig 20 to review the data output by the sensors 40. Thus, the distributed network nodes 30 provide measurements that give drillers or another individual additional insight into what is happening along the potentially miles-long length of the drill string 12. Besides the absolute value of pressure at each node 30, the gradients of the intervals between the various nodes 30 can also be calculated based on the change in the measured absolute values at each node 30. These absolute values and gradient values may then be tracked as time advances. Observed variations over time in absolute measurements and the associated gradients may then be compared by preprogramed software, such that the specific conditions occurring in the down-hole environment may be monitored. As a result of this analysis, drillers may be able to make more informed decisions as more fully explained below.

Figure 2:
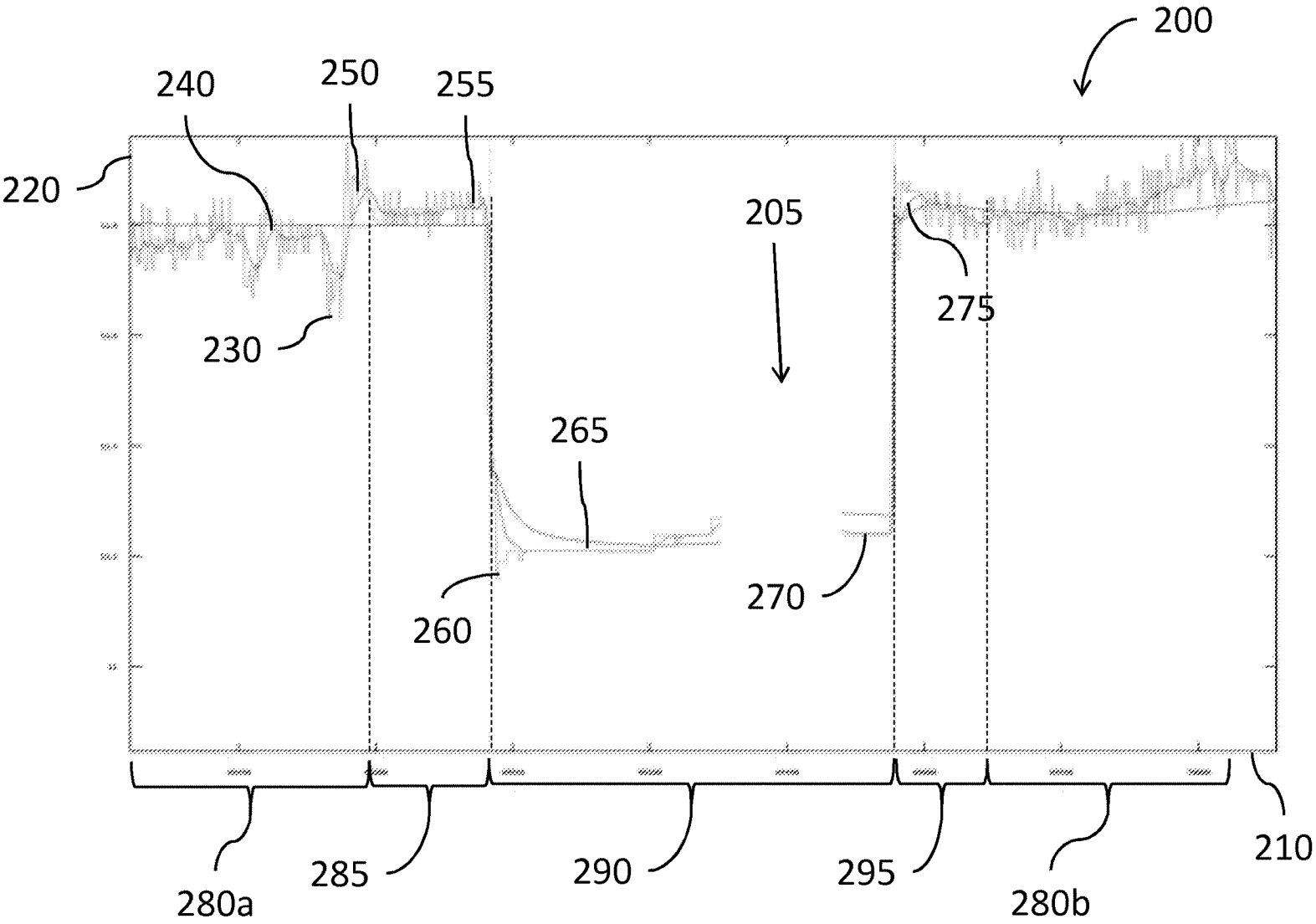
FIG. 2 is a graph of annular pressure data acquired around a drill pipe connection.

Equivalent density is computed as the ratio of the down-hole pressure, usually expressed in pounds-force per square inch or in bars, to the true vertical depth, usually expressed in feet or meters. With appropriate conversion factors, the equivalent density may be expressed in pounds per gallon or in grams per cubic centimeters. The equivalent density represents the density required for a fluid column of a height equal to the true vertical depth of the measurement point to generate the measured pressure. FIG. 2 illustrates annular pressure data in the form of equivalent densities that may be acquired around a drill pipe connection time 205. Graph 200 shows curves of equivalent density 220 as a function of time 210. Curve 230 represents an essentially unprocessed or unfiltered measurement, and curve 240 represents a processed or filtered measurement. The processing may include removal of outliers, and low pass filtering, among other signal processing techniques. In some embodiments, the processing may be used for identification of the equivalent density during the connection in cases heave causes fluctuation on the equivalent density. For example, heave may cause fluctuations or periodic variations of the equivalent density as the drill string is held in slips, and signal processing may be used to remove these periodic variations from the computed equivalent density in order to identify a "static" equivalent density. The processing may include averaging the equivalent density data over a period, applying a median filter on the equivalent density data over a period, or other type of filter such as a frequency band stop filter.

Any of the two curves may be analyzed in periods, including drilling periods 280*a* and 280*b*, a clean-up period 285, a pumps-off period 290, and a pump ramp-up period 295. For example, when drilling has progressed during drilling period 280*a* as far as the drill string can extend without an additional joint of drill pipe, the drilling fluid may be circulated without drilling the formation, or sometime while reaming the formation, during clean-up period 285. While clean-up is sometimes associated with a transition between drilling fluid and completion fluid, clean-up refers herein to circulation periods wherein drilling fluid is pumped into the wellbore to move the cuttings above a distance above the BHA and to prevent cutting settlement on top of the BHA components. Clean-up is not necessarily a complete evacuation of all cuttings from the wellbore, and may achieve only a relative cutting density reduction around the bottom of the drill string or around the BHA. The mud circulating pumps are deactivated during pumps-off period 290, and the end of the drill string is set in holding slips (at 260) that support the weight of the drill string, the BHA and the drill bit. The kelly or top drive is then disconnected from the end of the drill string; an additional joint of drill pipe is threaded and torqued onto the exposed, surface end of the drill string. The kelly or top drive is then reconnected to the top end of the newly connected joint of drill pipe. Once the connection is made, the mud pumps are reactivated to power the drill motor during pump ramp-up period 295, and drilling resumes during drilling period 280*b*. Preprogrammed software may be used to identify values that are indicative of the pressure data in the different periods. For example, ECD value 250 may be indicative of the drilling period occurring prior to making the connection. It may be obtained from a time average of data prior to the clean-up period 285. Similarly, ECD value 255 may be indicative of the clean-up period occurring prior to making the connection, and ECD value 275 of the pump ramp-up period occurring after making the connection. During the pumps-off period 290, two values may be identified: ESD value 265 may be indicative of the pumps-off period prior to making the connection, and ESD value 270 may be indicative of the pumps-off period prior to making the connection.

In the example shown in FIG. 2, the equivalent static density changes during the pumps-off period around the drill pipe connection 205. The equivalent density is initially at value 265 after transient effect (at 260) caused by the drill string being set in slips, and then increases to value 270 after the drill pipe connection 205. The equivalent density may decrease during the pumps-off period depending on the amount of cuttings that settles, or similarly, depending on the distance between cuttings and the bottom of the wellbore, well orientation and drilling fluid properties. And the equivalent density may increase depending on thermal expansion of the drill string and drilling fluid. A large downward variation of equivalent density suggests that cuttings may pack-off at the bottom of the wellbore and that the clean-up duration is too short; in other words, the clean-up is performed too aggressively. Conversely, a large upward variation of equivalent density suggests that the wellbore may have been excessively cooled and cleaned prior to the pumps-off and the clean-up duration is too long; in other words, the clean-up is performed too conservatively. Or the large upward variation suggests that the duration of pipe connection lasted a long time.

Further, the equivalent circulating density changes during the clean-up and ramp-up periods around the connection 205. The equivalent density is at the maximum (value 250) just before the clean-up period 285, and then reduces during the clean-up period to value 255. The equivalent density during the drilling and clean-up periods increases with the rate at which cuttings are generated, that is, according to the rate of penetration of the drill bit in the formation rock, and decreases with the rate at which cuttings are evacuated by circulation of the drilling fluid. A large upward variation of equivalent density suggests that drilling may be performed too aggressively. Conversely, a large downward variation of equivalent density suggests that cuttings may be evacuated very efficiently from the wellbore and drilling is perhaps advancing at a too conservative rate, or that clean-up periods may be longer than needed.

Thus, the example shown in FIG. 2 shows that variations of ECD or ESD values before and after the connection may be used as indicators of the risk generated by the ongoing drilling operations and of the performance of these operations. These variations may be compared with threshold values to determine the aggressiveness and/or the conservativeness of wellbore drilling operations. Further, the aggressiveness and/or the conservativeness of wellbore drilling operations may be used to improve or optimize drilling operations as described herein. The interpretation of the evolution of annular pressure described in relation with the example graph of FIG. 2 may be generalized using a method of measuring performance and quantifying risk as described by the flow chart 300 of FIG. 3. The method may be used to quantify the levels of equivalent density variations associated with 1) uneconomical or suboptimal performance or low risks, and 2) high performance and high risks.

At block 310, values of annular pressure are acquired. These values may be actual annular pressure measurements performed in a wellbore being drilled, in wellbores having been drilled in an area of interest near the wellbore being drilled, or in other wellbores identified for their similarity with the wellbore being drilled, such as wellbores drilled through similar rock formations. Alternatively or additionally, these values may be computed using a fluid circulation model of the wellbore being drilled. These values may represent the evolution of annular pressure around a plurality of drill pipe connections. For example, the evolution of annular pressure around fifty, or any other number of different drill pipe connections may be acquired.

At block 320, equivalent densities are optionally computed from the annular pressure values as described herein. Equivalent densities may sometimes be easier to interpret because equivalent density combines the effect that true vertical depth has on annular pressure. However, annular pressures may also be used instead on equivalent densities without departing from the scope of the present disclosure. Further, the equivalent densities may optionally be normalized over a drilling interval, such as between zero and one. Normalization may facilitate a meaningful comparison between different drilling intervals, different wellbores, or different drilling conditions. Still further, the equivalent densities may optionally be processed and/or filtered using signal processing methods known in the art or developed in the future. Thus, annular pressure data include, but are not limited to, unprocessed and unfiltered annular pressure values, processed or filtered annular pressure values, unprocessed and unfiltered equivalent density values, and processed (e.g., normalized) and filtered equivalent density values.

At block 330, the evolution of the equivalent density values around each connection is analyzed. For example as shown in FIG. 2 for a single connection, the equivalent density values may be parsed based on the acquisition time of the values into a first drilling period, a clean-up period, a pumps-off period, a pump ramp-up or slow-down period, and a second drilling period. However the equivalent density values may be parsed into fewer periods, for example the clean-up period may be omitted. The equivalent density values may also be parsed into additional periods, such as a setting-in-slips period, a picking-off-slips periods, tripping periods, etc. . . . . At least one equivalent density value may then be identified in each of the period for each connection. For example, an average of a few latest values, such as the last five values, or the values acquired in the last five seconds, before the end of each period may be identified. As shown in FIG. 2, value 250 may be identified just before the end of first drilling period 280*a*, value 255 may be identified just before the end of clean-up period 285, and value 270 may be identified just before the end of pumps-off period 290. Alternatively or additionally, an average of a few earliest values, such as the first five values or the values acquired in the first five seconds, after the beginning of each period may be identified. For example as shown in FIG. 2, value 265 may be identified just after the beginning of pumps-off period 290, and value 275 may be identified just after the beginning of pump ramp-up or slow-down period 295. Average over a larger or lower number of values, or over a longer or shorter time interval, and other identifying methods, such as identifying a median value, a maximum value, or a minimum value on a sub-interval of each period may also be used.

Thus, in cases where fifty different drill pipe connections are analyzed at block 330, fifty equivalent density values may be identified in the different drilling periods preceding the fifty drill pipe connections, fifty more equivalent density values may be identified in the different clean-up periods, and fifty more equivalent density values may be identified in the different pump ramp-up or slow-down periods, etc. . . . . Variations of equivalent density may be computed by difference of the identified values in the different periods around a single drill pipe connection, or by difference of identified values in one single period, or even by computing standard deviation or other indices of variation of the equivalent density in a single period.

At block 340, the variations of equivalent density may be analyzed as a function of drilling conditions. For example, the equivalent density variations between the beginning and the end of the pumps-off period may be parsed into the variations that correspond to data acquired in water based mud ("WBM") and the variations that correspond to data acquired in oil based mud ("OBM"). Similarly, the equivalent density variations between the clean-up period and the pump ramp-up or slow-down period may be parsed into the variations that correspond to data acquired in WBM and the variations that correspond to data acquisition in OBM. In this example, the variations are analyzed as a function of mud type, wherein the mud type is either WBM or OBM. Additionally or alternatively, other drilling conditions may be analyzed in a way similar to mud types. These drilling conditions may also include, but are not limited to, formation type, wellbore inclination, etc. . . . . Formation type may include, but is not limited to, soft rock, hard rock, sticky rock, etc. . . . .

At block 350, the trend of equivalent density variations as a function of time, wellbore length, or driller depth is determined, such as by using regression analysis or other methods. For example, the equivalent density variations between the beginning and the end of the pumps-off period acquired in drilling muds of a given type, in rocks of a given type, and in wellbores with similar trajectory or directional profiles may increase with the length of uncased wellbore that has been drilled, for example regardless of the rig crew tour that has operated the drilling equipment. And this increasing trend may be determined at step 350. Conversely, the equivalent density variations between the clean-up period and the pump ramp-up or slow-down period acquired in drilling muds of the same type, in rocks of the same type, and in vertical wells may decrease with the length of uncased wellbore that has been drilled, for example regardless of the rig crew tour that has operated the drilling equipment. And this decreasing trend may also be determined at step 350. Further, the trends determined at block 350 may be extrapolated to lengths of uncased wellbore for which no annular pressure data has been acquired. Still further, annular pressure and/or equivalent density variations may be corrected for the difference of length of uncased wellbore that has been drilled, and be expressed as variations at a given nominal length, such as at one thousand feet of uncased wellbore, or any other length.

At block 360, the equivalent density variations may be correlated to drilling efficiency. For example, drilling efficiency may comprise the total duration of the clean-up, the pumps-off, and the pump ramp-up or slow-down periods. The equivalent density variations may also be correlated to drilling risk. For example, drilling risk may comprise a simulated value of the amount of cuttings suspended in the wellbore at the end of the clean-up period, or a simulated value of the amount of cuttings that has settled at the end of the pumps-off period.

The correlation performed in some embodiments of block 360 may indicate that a large negative variation of the equivalent density between the beginning and the end of the pumps-off period (i.e., ESD after-ESD before) is associated with efficient but risky drilling operations. Also, the correlation may indicate that a large positive variation of the equivalent density between the beginning and the end of the pumps-off period is associated with low risk but uneconomical or suboptimal drilling operations.

The correlation performed in other embodiments of block 360 may indicate that a large variation, either positive or negative, of the equivalent density between the clean-up period and the pump ramp-up period (i.e., ECD after-ECD before) is associated with efficient but risky drilling operations. Also, the correlation may indicate that a small variation, either positive or negative, of the equivalent density between the clean-up period and the pump ramp-up or slow-down period is associated with low risk but uneconomical or suboptimal drilling operations.

The correlation performed in yet other embodiments of block 360 may indicate that a small positive or negative variation of the equivalent density between the clean-up period and the first drilling period (i.e., ECD kelly down-ECD before) is associated with efficient but risky drilling operations. Also, the correlation may indicate that a large positive variation of the equivalent density between the clean-up period and the first drilling period is associated with low risk but uneconomical or suboptimal drilling operations.

The correlation performed in yet other embodiments of block 360 may indicate that a large positive variation of the equivalent density between the beginning of the pumps-off period and the clean-up period (ECD before-ESD before) is associated with efficient but risky drilling operations. Also, the correlation may indicate that a small positive variation of the equivalent density between the clean-up period and the beginning of the pumps-off period is associated with low risk but uneconomical or suboptimal drilling operations.

At block 370, a statistical analysis on the variations of equivalent density correlated with low risk but uneconomical or suboptimal drilling operations may be used to quantify the threshold beyond which variations may be indicative of uneconomical or suboptimal performance and low risk. If the data used are equivalent densities for example, a variation of equivalent density of a magnitude less than the threshold of one half pounds per gallon (0.5 ppg), or any other value determined from the statistical analysis, may be uneconomical or suboptimal. If the data used are equivalent densities normalized between zero and one for example, a variation of equivalent density of a magnitude less than the threshold of forty percent (40%), or any other value determined from the statistical analysis, may be uneconomical or suboptimal.

At block 380, a statistical analysis on the variations of equivalent density correlated with efficient but risky drilling operations may be used to quantify the threshold beyond which variations may be indicative of high risk and high performance. If the data used are equivalent densities for example, a variation of equivalent density of a magnitude greater than the threshold of one pound per gallon (1 ppg), or any other value determined from the statistical analysis, may be highly risky. If the data used are equivalent densities normalized between zero and one for example, a variation of equivalent density of a magnitude greater than the threshold of seventy percent (70%), or any other value determined from the statistical analysis, may be uneconomical or suboptimal.

The thresholds determined at blocks 370 and 380 may depend on the drilling conditions. For example, the threshold may differ in WBM and in OBM, and/or may depend on other drilling conditions analyzed at block 340, such as formation type, wellbore inclination, etc. . . . . Also, the thresholds determined at blocks 370 and 380 may depend on the length of uncased wellbore. For example, the threshold may follow the trend determined at block 350.

Figure 4:
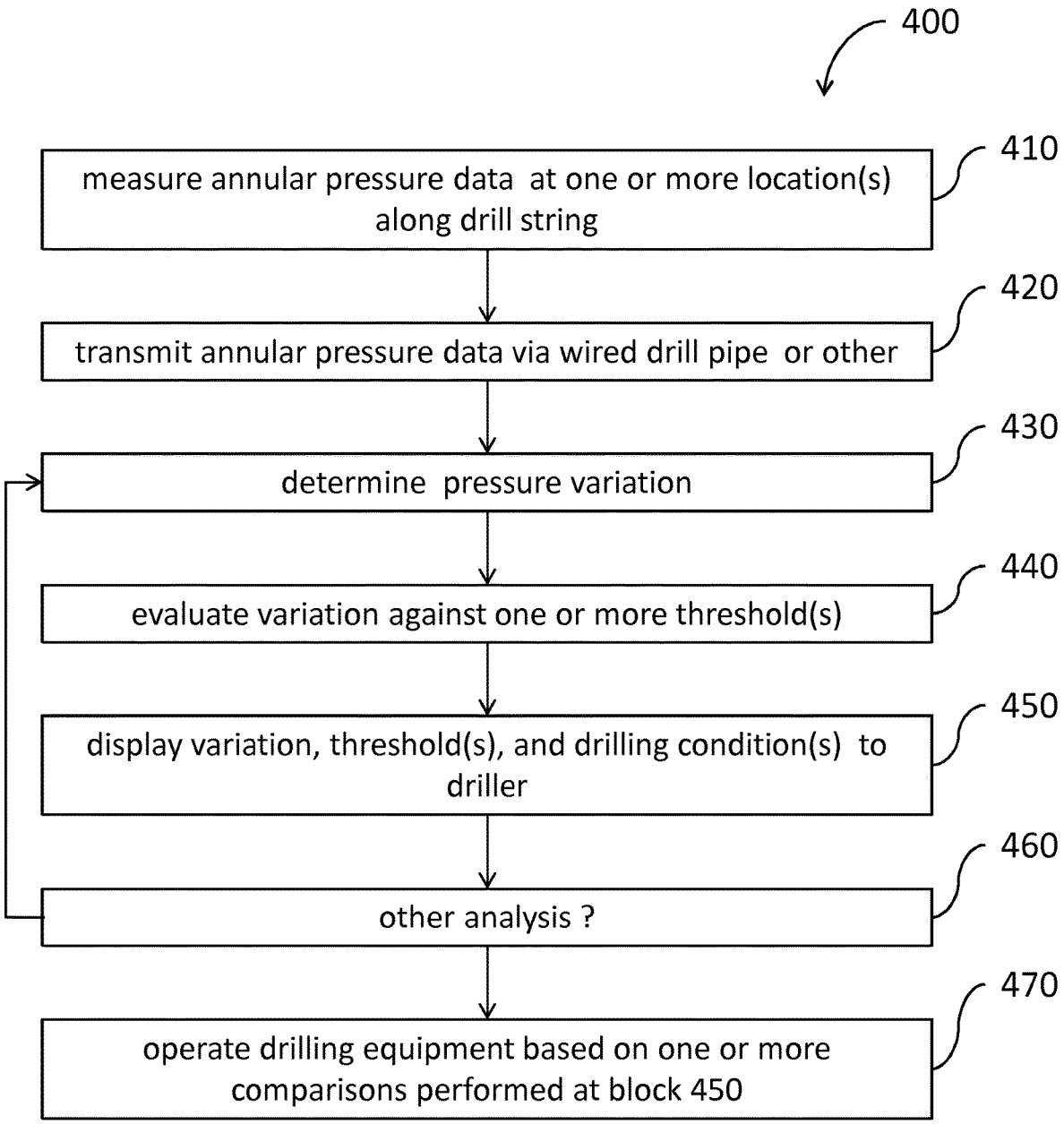
FIG. 4 is a flow chart of a method of operating wellbore drilling equipment.

The threshold values computed in accordance with the present disclosure are thus indicative of limits between aggressive and/or conservative of drilling operations. Variations of annular pressure measured around a drill pipe connection may be compared in real-time or near real-time with corresponding threshold values and the drilling operations may be adjusted based on the comparison as described in the flow chart 400 of FIG. 4. The flow chart 400 illustrates a method that may be used to change or adjust a pumping rate or a pumping duration based on the comparison; and a drilling fluid circulation pump may be operated (e.g., controlled) at the adjusted pumping rate or for the determined pumping duration subsequent the drill pipe connection. The method may also be used to change or adjust circulation flow rate, weight on bit and string rotation speed during a drilling period subsequent the connection.

At block 410, annular pressure data may be measured at one or more locations along drill string 12 using sensors 38, 40 shown in FIG. 1. Other data, such as temperature data may also be measured at block 410.

At block 420, the annular pressure data measured at block 410 may be transmitted to a well site computer or to a remote computer using a data transmission system, such as the WDP transmission system 46 shown in FIG. 1. For example, the data may be first converted in equivalent density using a true vertical depth ("TVD") computed by the well site computer or to the remote computer. The equivalent density may be processed and filtered.

At block 430, pressure variations around one given pipe connection are determined in real-time or near real-time. Preprogrammed software may be used to identify values that are indicative of equivalent density in the different periods or in the same period as described herein and illustrated for example in FIG. 2. A pressure variation may be determined from identified first and second values. The variation may be normalized.

Figure 3:
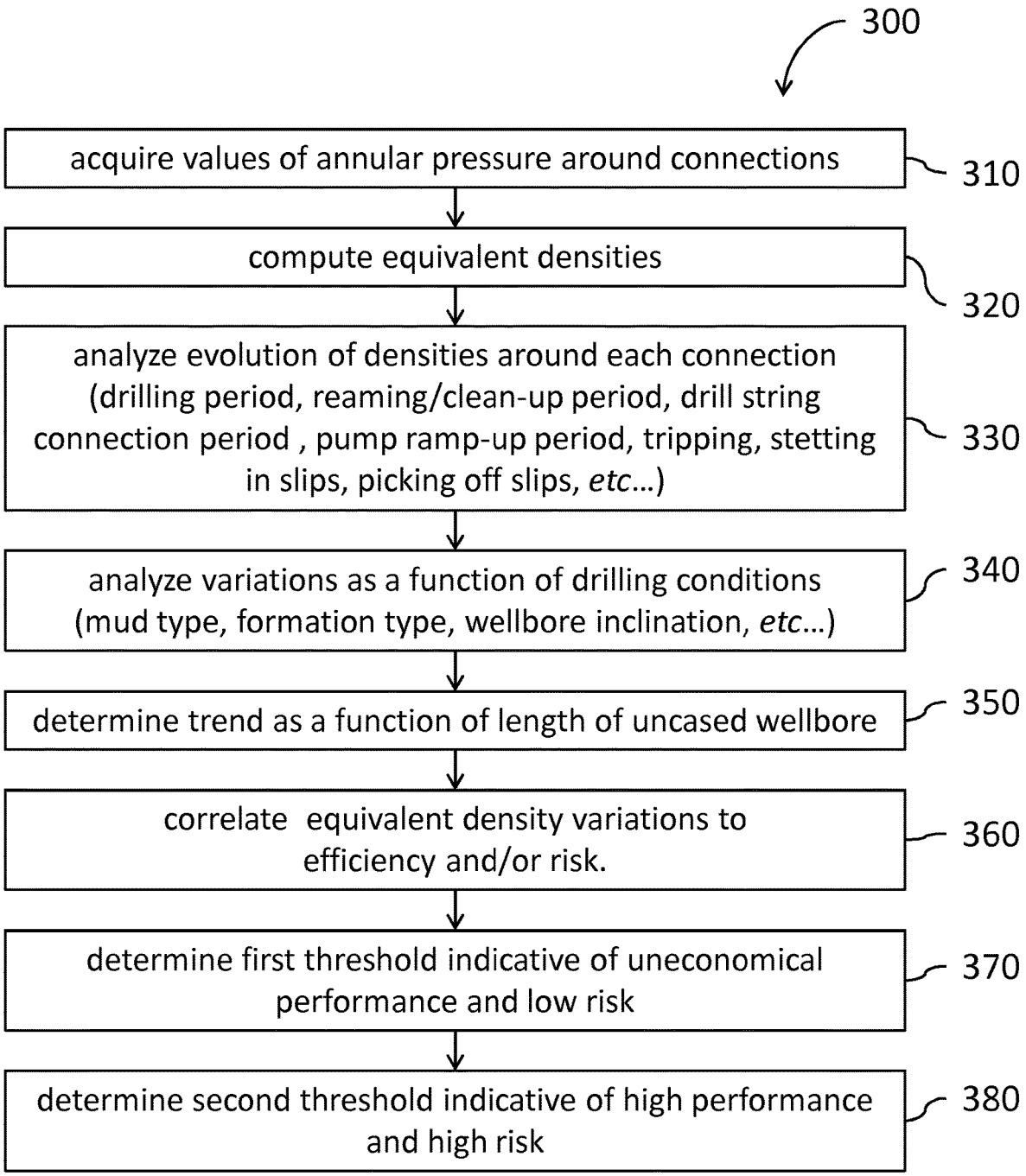
FIG. 3 is a flow chart of a method of measuring performance and quantifying risk.

At block 440, the variation is compared to threshold values, for example the pairs of threshold values determined using the method of measuring performance and quantifying risk shown in FIG. 3. In some example embodiments, the comparison with one of the threshold values may suggests that duration of clean-up periods before connections is too long, or the comparison with the other of the threshold values may suggests that the duration is too short. In some other example embodiments, the comparison with one of the threshold values may suggests that the pumping rate of the circulation pump during ramp-up or slow-down periods increases too slowly or the comparison with the other of the threshold values may suggests that the pumping rate increases too fast. In yet some other example embodiments, the comparison with one of the threshold values may suggests that the rate of penetration of the drill bit is too slow, or the comparison with the other of the threshold values may suggests that the rate of penetration of the drill bit is too fast.

Figure 5:
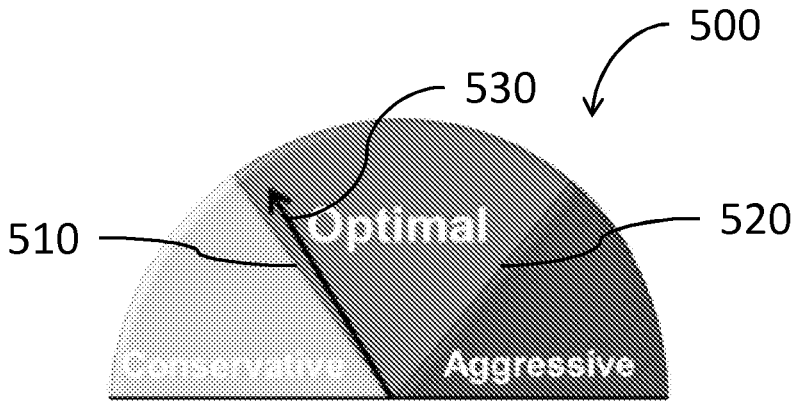
FIG. 5 is a display that may be used in accordance with the method of FIG. 4.
Figure 6:
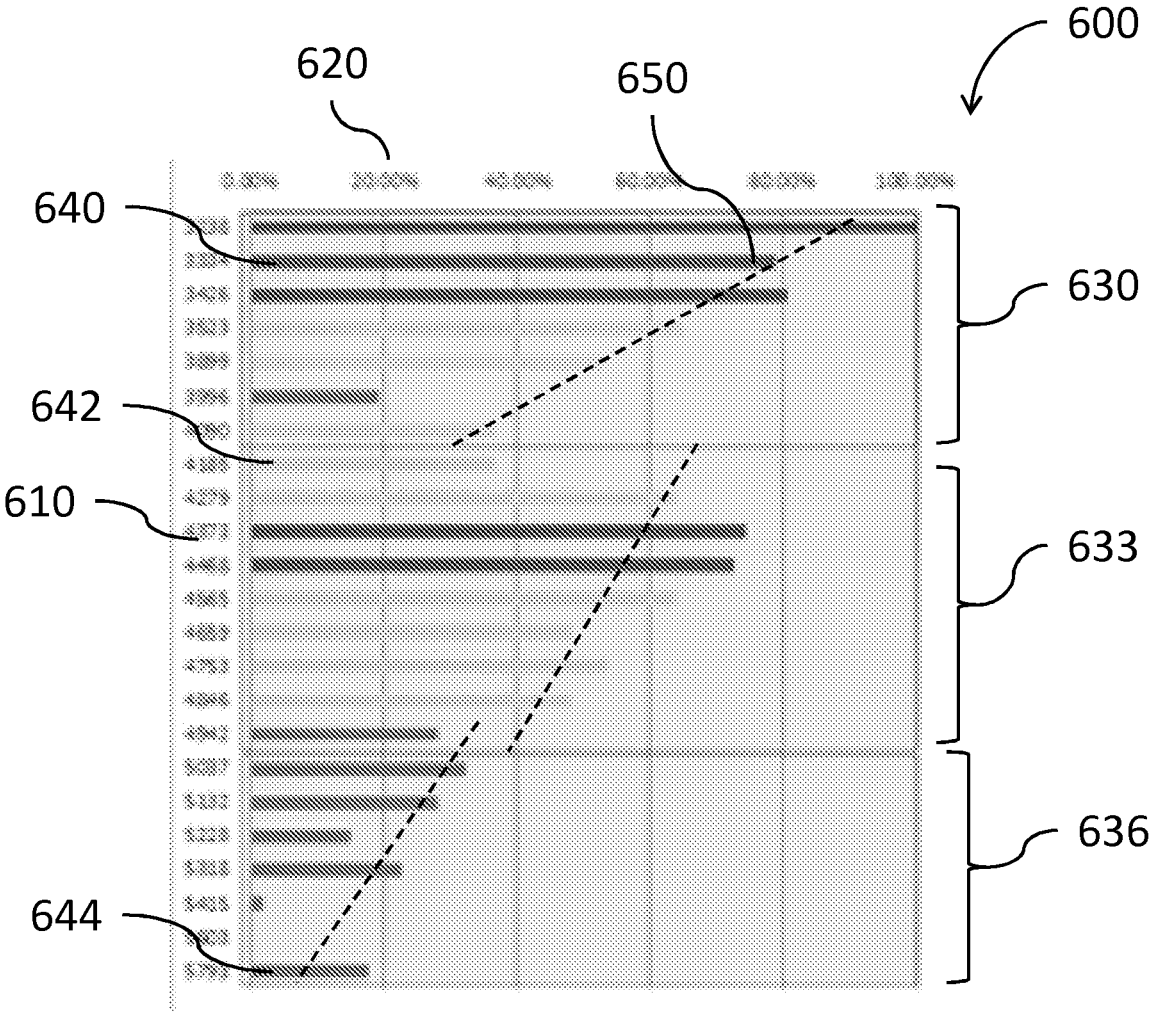
FIG. 6 is another display that may be used in accordance with the method of FIG. 4.
Figure 7:
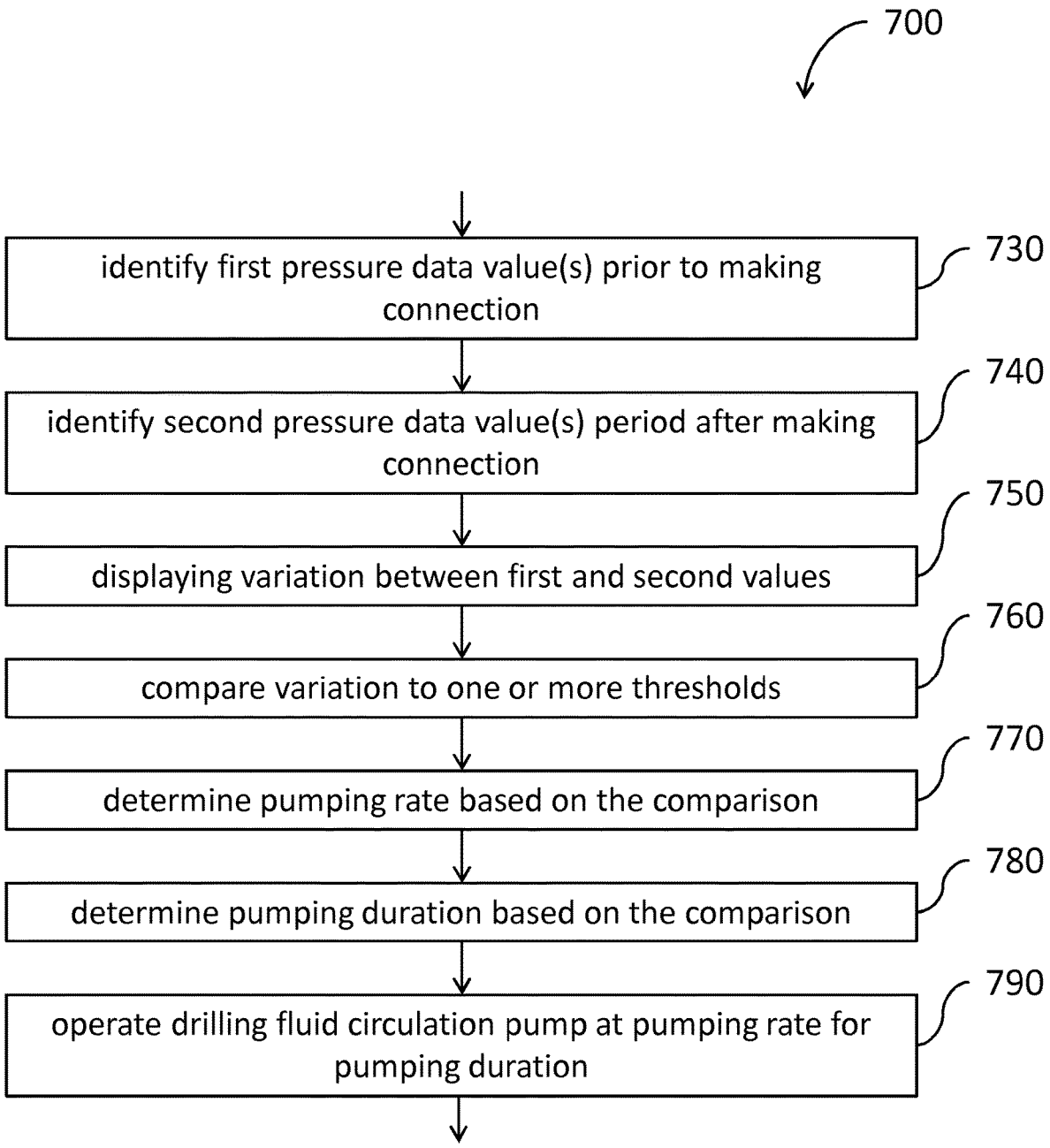
FIG. 7 is a flow chart of a method of operating a fluid circulation pump based on pressure data value acquired during a pumps-off period around a drill pipe connection.
Figure 8:
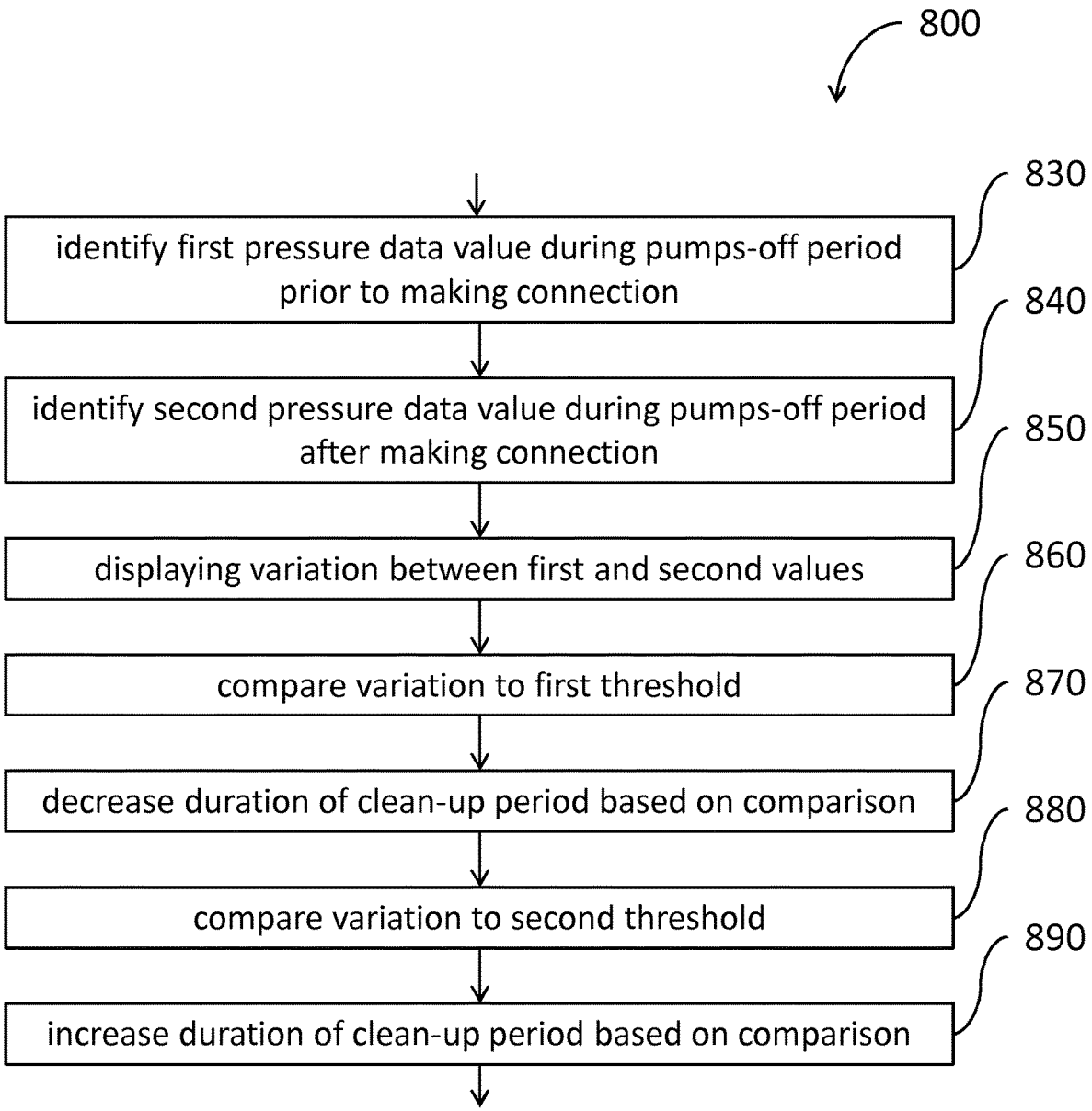
FIG. 8 is a flow chart of a method of changing the duration of operation of a fluid circulation pump during a fluid clean-up period.
Figure 9:
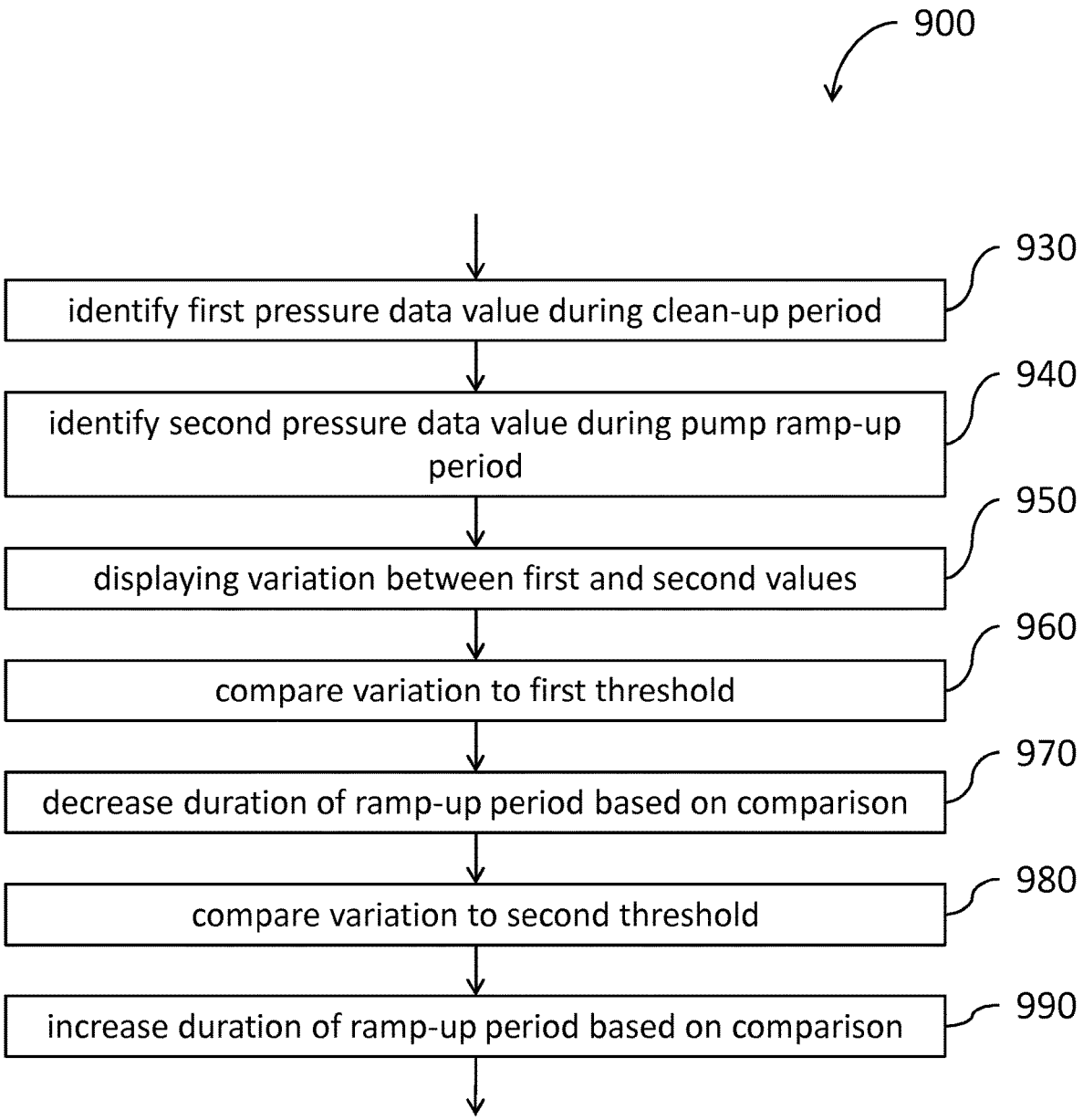
FIG. 9 is a flow chart of a method of changing the duration of operation of a fluid circulation pump during a pump ramp-up or slow-down period.
Figure 10:
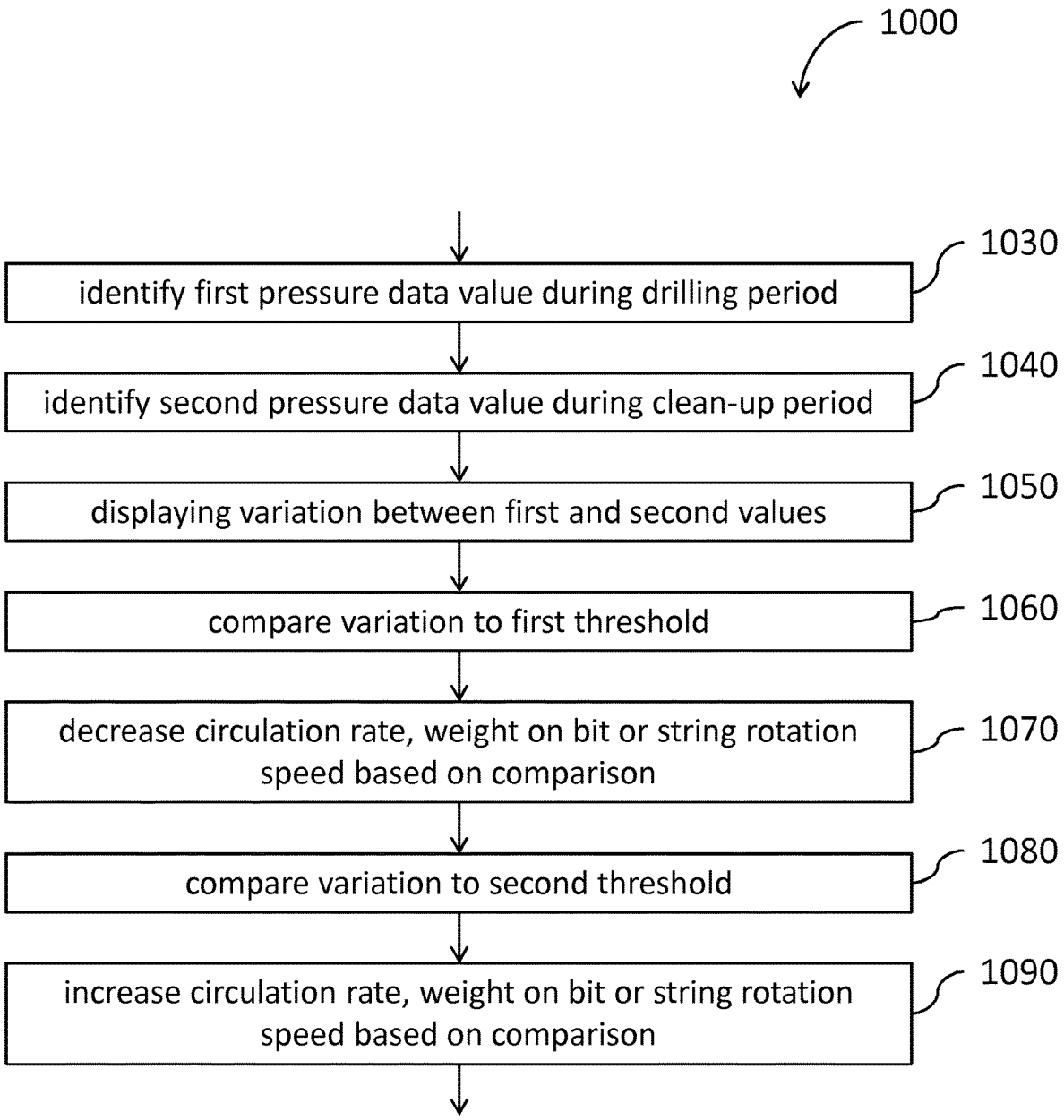
FIG. 10 is a flow chart of a method of changing the operation of wellbore drilling equipment during a drilling period.
Figure 11:
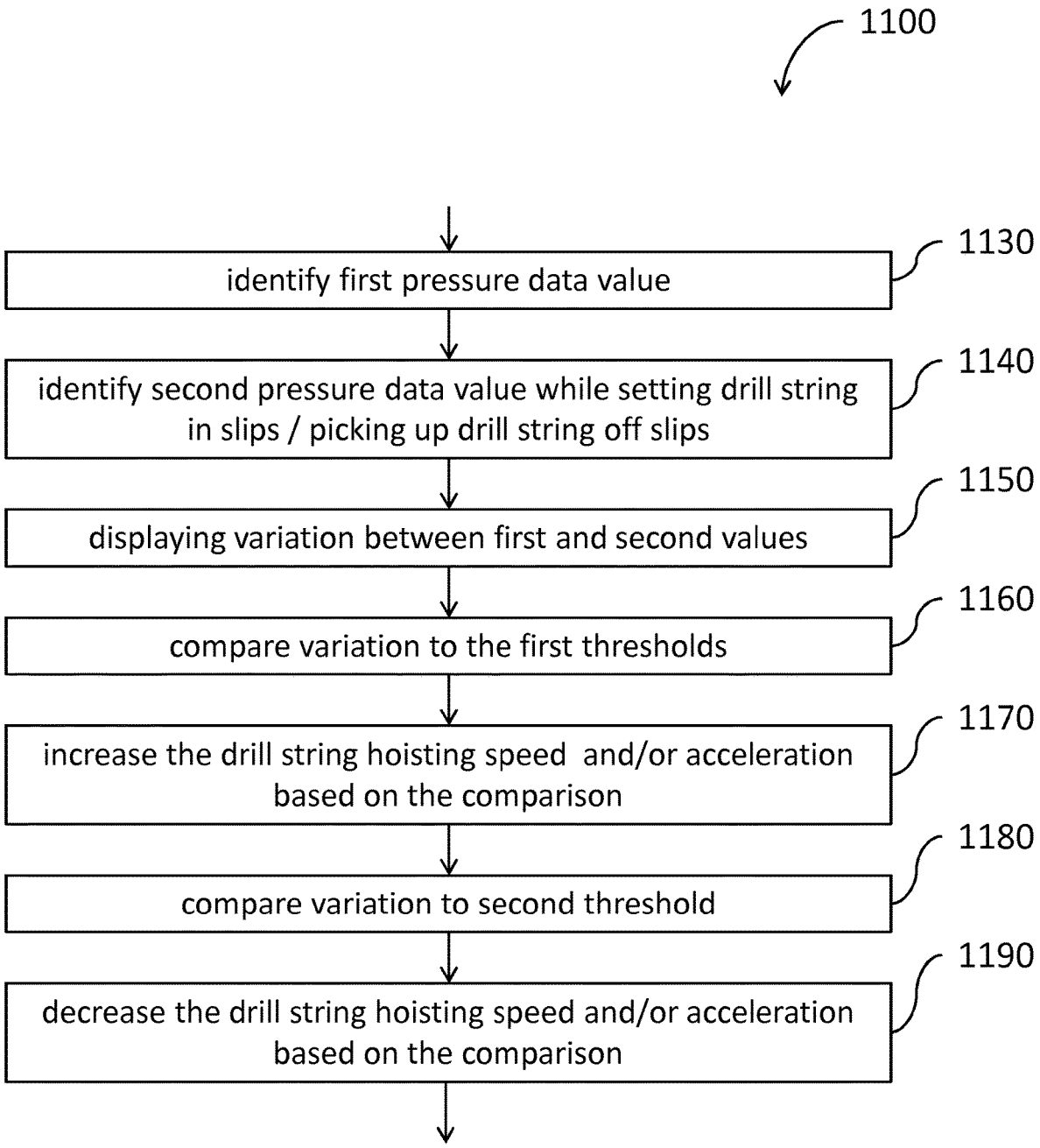
FIG. 11 is a flow chart of a method of changing the operation of a draw-work during setting a drill string in slips or picking a drill string off slips.

At block 450, the variation, threshold(s), and drilling condition(s) may be displayed to a driller. As shown for example in FIG. 5, the variation 530 between first and second values and the threshold value (510, 520) may be displayed on a visualization dial 500. In this example, the threshold value 510 may correspond to a value beyond which drilling operations are low risk but uneconomical or suboptimal. The threshold value 520 may correspond to a value beyond which drilling operations are efficient but risky. As shown for example in FIG. 6, block 450 may alternatively or additionally comprise adding the variation between first and second values on a log 600 including indications of drilling conditions. The log 600 may comprise a chart of amplitude 620 of normalized variation (increasing toward the right of FIG. 6) as a function of drill pipe connection depth (or time) 610 (increasing toward the bottom of FIG. 6). The variation may be added as a bar 644 at the bottom of the log 600, below the bars corresponding to the variations previously displayed on the log 600. Each bar of the chart may be colored based on the comparison with the threshold values indicative of low risk but uneconomical or suboptimal operations, and efficient but risky operations. For example, bar 640 corresponding to a variation measured near the beginning of the log 600 may be colored to indicate a variation value that falls beyond the threshold value indicative of efficient but risky operations. Bar 644 corresponding to the variation measured the latest during the drilling operation may be colored to indicate a variation value that falls beyond the threshold value indicative of low risk but uneconomical or suboptimal operations. Similarly bar 642 may be colored to indicate a variation value that falls neither beyond the threshold value indicative of efficient but risky operations, nor beyond the threshold value indicative of low risk but uneconomical or suboptimal operations. Also shown in log 600 are indications of rig crew tours 630, 633, 636. Indications of rig crew tours may be used to compare the performance between drillers for examples. In the shown example, the driller of rig crew tour 630 may have operated the drilling equipment in an efficient but risky way, whereas the driller of rig crew tour 636 may have operated the drilling equipment in a low risk but uneconomical or suboptimal way. Other drilling conditions (not shown) may comprise at least one of mud type, formation type, and wellbore inclination. These drilling conditions may help explain the variations shown in log 600. Also shown in log 600 are trends 650, such as trend with time or wellbore length. Trends 650 may also be used to quantify risk and evaluate performance.

Returning to FIG. 4, a determination of whether another analysis is to be performed is made at block 460. For example, the variation of the equivalent density between the beginning and the end of the pumps-off period at a first location along the drill string may be determined, evaluated and displayed in a first instance of blocks 430, 440 and 450. In some cases, it may be useful to determine, evaluate and display the variation of the equivalent density between the beginning and the end of the pumps-off period at other locations different from the first location in subsequent instances of blocks 430, 440 and 450. In some cases, it may be useful to also determine, evaluate and display the variation of the equivalent density between the clean-up period and the pump ramp-up or slow-down period, the variation of the equivalent density between the first drilling period and the clean-up period, and/or the variation of the equivalent density between the clean-up period and the beginning of the pumps-off period in subsequent instances of blocks 430, 440 and 450. Thus, multiple visualization dials 500 and logs 600 corresponding to variations between different types of periods may be displayed to the driller.

At block 470, the drilling equipment may be operated (e.g., actuated, controlled, etc. . . . ) based on one or more comparisons performed at block 450 as described herein, for example in the description of FIGS. 7, 8, 9 and 10.

One example embodiment of blocks 430, 440, 450, 460, and 470 is shown in flow chart 700. At block 730, at least a first pressure data value (e.g., a static value) is identified during a pumps-off period prior to making a connection. Optionally, other pressure data values may also be identified, for example a dynamic value during a circulation period, etc. . . . . At block 740, at least a second pressure data value is identified after making the connection. Again, other pressure data values may also be identified, for example a dynamic value during a pump ramp-up or slow-down period, etc. . . . . At block 750, the variation between first and second values is displayed. At block 760, the variation is compared to one or more thresholds. At optional block 770, a pumping rate, for example the pumping rate used during a subsequent ramp-up or slow-down period, or the pumping rate used during a subsequent drilling period, is determined based on the comparison. For example, the pumping rate may be decreased from a currently used value by five percent or by any other value when the variation value is beyond the threshold value indicative of efficient but risky operations. The pumping rate may alternatively be increased from the currently used value by five percent or any other value when the variation value is beyond the threshold value indicative of low risk but inefficient operations. The pumping rate may otherwise remain unchanged. At optional block 780, a pumping duration, for example the pumping duration used during a subsequent ramp-up or slow-down period, or the pumping duration used during a subsequent clean-up period is determined based on the comparison. For example, the pumping duration may be increased from a currently used value by five percent or by any other value when the variation value is beyond the threshold value indicative of efficient but risky operations. The pumping duration may alternatively be decreased from the currently used value by five percent or any other value when the variation value is beyond the threshold value indicative of low risk but inefficient operations. The pumping duration may otherwise remain unchanged. At block 790, the drilling fluid circulation pump is operated at the pumping rate and for pumping duration determined at blocks 770 and/or 780.

Another example embodiment of blocks 430, 440, 450, 460, and 470 is shown in flow chart 800. At block 830, a first pressure data value is identified during a pumps-off period prior to making a connection. At block 840, a second pressure data value is identified during a pumps-off period after making the connection. At block 850, the variation between first and second values is displayed. At block 860, the variation is compared to a first threshold indicative of low risk but uneconomical or suboptimal operations. At block 870, a duration to be used for cleaning-up the wellbore prior to the subsequent drill pipe connection is made shorter than the duration used prior to the current drill pipe connection when the variation between first and second values is greater than the first threshold, or at least as long as the duration used prior to the current drill pipe connection when the variation between first and second values is not smaller than the first positive threshold. At block 880, the variation is compared to a second threshold indicative of efficient but risky operations. At block 890, the duration to be used for cleaning-up the wellbore prior to the subsequent drill pipe connection is made longer than the duration used prior to the current drill pipe connection when the variation between first and second values is less than the second negative threshold, or at least as long as the duration used prior to the current drill pipe connection when the variation between first and second values is not larger than the second threshold.

Another example embodiment of blocks 430, 440, 450, 460, and 470 is shown in flow chart 900. At block 930, a first pressure data value is identified during a clean-up period prior to making a connection. At block 940, a second pressure data value is identified during pump ramp-up period after making the connection. At block 950, the variation between first and second values is displayed. At block 960, the variation magnitude is compared to a first small threshold indicative of low risk but uneconomical or suboptimal operations. At block 970, a duration to be used for kicking-in the pumps after the subsequent drill pipe connection is made shorter than the duration used after the current drill pipe connection when the variation magnitude is less than the first threshold, and a corresponding pumping rate may be increased. At block 980, the variation magnitude is compared to a second large threshold indicative of efficient but risky operations. At block 990, the duration to be used for kicking-in the pumps after the subsequent drill pipe connection is made longer than the duration used after the current drill pipe connection when the variation magnitude is larger than the second threshold, and a corresponding pumping rate is decreased.

Another example embodiment of blocks 430, 440, 450, 460, and 470 is shown in flow chart 1000. At block 1030, a first pressure data value is identified during a clean-up period prior to making the connection. At block 1040, a second pressure data value is identified during a drilling period prior to making a connection. At block 1050, the variation between first and second values is displayed. At block 1060, the variation is compared to a first large threshold indicative of low risk but uneconomical or suboptimal operations. At block 1070, the weight on bit is increased, and/or the string rotation speed is increased when the variation is higher than the first threshold, and a circulation rate may also be decreased. Increasing the weight on bit may be achieved by increasing the drill string hoist slack off, and in other words, by increasing the rate of penetration ("ROP") of the bit. At block 1080, the variation magnitude is compared to a second small threshold indicative of efficient but risky operations. At block 1090, the weight on bit is decreased, and/or the string rotation speed is decreased when the variation is lower than the first threshold, and a circulation rate may also be increased.

Another example embodiment of blocks 430, 440, 450, 460, and 470 is shown in flow chart 1100. At block 1130, a first pressure data value is identified. At block 1140, a second pressure data value is identified while setting drill string in slips, or while picking up drill string off slips. At block 1150, the variation between first and second values is displayed. In cases where the first pressure data is identified during a pumps-off period when the drill string is stationary in the wellbore, the first value is a pressure baseline, and the variation between the first and second values may be a relative pressure change mainly influenced by the speed of the drill string while setting it in slips, or while picking it up off slips. In cases where both the first and second values are identified while setting drill string in slips or while picking up drill string off slips, the variation between first and second values maybe a pressure change rate mainly influenced by the acceleration of the drill string while setting it in slips, or while picking it up off slips. At block 1160, the variation magnitude is compared to a first small threshold indicative of low risk but uneconomical or suboptimal operations. At block 1170, at least one of the speed and the acceleration of the traveling block or other hoisting equipment is increased when the variation is lower than the first threshold. At block 1180, the variation magnitude is compared to a second large threshold indicative of efficient but risky operations. At block 1190, at least one of the speed and the acceleration of the traveling block or other hoisting equipment is decreased when the variation is higher than the second threshold.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method, comprising:

acquiring annular pressure data from a wellbore, wherein the annular pressure data is acquired over a time interval and at least a portion of the annular pressure data is acquired during a pumps-off period;

identifying at least first and second values from the annular pressure data;

comparing the variation between first and second values to a first threshold, wherein the first threshold follows a trend over a plurality of different drill pipe connections of variations of annular pressure data, wherein the trend is a function of length of uncased wellbore; and increasing at least one of drill string hoisting speed, and drill string hoisting acceleration based on the comparison with the first threshold.

2. The method of claim 1, wherein the annular pressure data comprise at least one of equivalent densities and normalized equivalent densities.

3. The method of claim 1, further comprising:

comparing the variation between the first and second values to a second threshold, wherein the second threshold follows a trend over the plurality of different drill pipe connections of variations of annular pressure data, wherein the trend is a function of length of uncased wellbore; and decreasing at least one of drill string hoisting speed, and drill string hoisting acceleration based on the comparison with the second threshold.

4. The method of claim 1, wherein the at least first and second values are identified from the annular pressure data measured during the pumps-off period, wherein the first value is identified prior to making a drill pipe connection and the second value is identified while setting a drill string in slips or while picking up the drill string off slips.

5. A method, comprising:

acquiring annular pressure data from a wellbore, wherein the annular pressure data is acquired over a time interval and at least a portion of the annular pressure data is acquired during a pumps-off period;

computing equivalent densities based upon the acquired annular pressure data;

determining a first threshold by correlating the equivalent densities to drilling efficiency; and determining a second threshold by correlating the equivalent densities to drilling efficiency, wherein the second threshold is different from the first threshold;

measuring annular pressure data within the wellbore;

identifying at least first and second values from the measured annular pressure data;

comparing the variation between first and second values to the first threshold and the second threshold; and operating drilling equipment based on the comparison with the first threshold and the second threshold.

6. The method of claim 5, wherein the at least first and second values are identified from the annular pressure data measured during the pumps-off period, wherein the first value is identified prior to making a drill pipe connection and the second value is identified after making the drill pipe connection.

7. The method of claim 5, wherein a pumping rate is determined based on comparing the variation to the threshold, and wherein a drilling fluid circulation pump is operated at the determined pumping rate during a pump ramp-up or slow-down period subsequent a drill pipe connection.

8. The method of claim 5, wherein a pumping duration is determined based on comparing the variation to the threshold, and wherein a drilling fluid circulation pump is operated for the determined pumping duration during a pump ramp-up or slow-down period subsequent a drill pipe connection.

9. The method of claim 5, wherein operating drilling equipment based on the comparison with the first threshold comprises controlling at least one of circulation rate, weight on bit, drill string rotation speed, drill string hoisting speed, and drill string hoisting acceleration.

10. A method comprising:

determining an equivalent density of a drilling fluid at a plurality of locations within a wellbore;

correlating the equivalent densities to drilling efficiency so as to determine a first threshold;

correlating the equivalent densities to drilling efficiency so as to determine a second threshold different from the first threshold;

acquiring annular pressure data from a location within the wellbore, wherein the annular pressure data is acquired over a time interval and at least a portion of the annular pressure data is acquired during a pumps-off period;

identifying at least first and second values from the annular pressure data;

comparing the variation between first and second values to the first threshold and the second threshold; and operating drilling equipment based on the comparison with the first threshold and the second threshold.

11. The method of claim 10, wherein the at least first and second values are identified from the annular pressure data measured during the pumps-off period, wherein the first value is identified prior to making a drill pipe connection and the second value is identified after making the drill pipe connection.

12. The method of claim 10, wherein operating the drilling equipment comprises controlling at least one of pump ramp-up, pump slow-down, circulation rate, weight on bit, drill string rotation speed, drill string hoisting speed, and drill string hoisting acceleration.

13. The method of claim 5 wherein operating drilling equipment based on the comparison with the first threshold and the second threshold includes controlling at least one of drill string hoisting speed, and drill string hoisting acceleration based on the comparison with the first threshold and the second threshold.

14. The method of claim 13 wherein the at least first and second values are identified from the annular pressure data measured during the pumps-off period, wherein the first value is identified prior to making a drill pipe connection and the second value is identified while setting a drill string in slips or while picking up the drill string off slips.

15. The method of claim 13 wherein controlling at least one of drill string hoisting speed, and drill string hoisting acceleration based on the comparison with the first threshold and the second threshold includes:

increasing at least one of drill string hoisting speed, and drill string hoisting acceleration based on the comparison with the first threshold; and decreasing at least one of drill string hoisting speed, and drill string hoisting acceleration based on the comparison with the second threshold.

16. The method of claim 10 wherein operating drilling equipment based on the comparison with the first threshold and the second threshold includes controlling at least one of drill string hoisting speed, and drill string hoisting acceleration based on the comparison with the first threshold and the second threshold.

17. The method of claim 16 wherein the at least first and second values are identified from the annular pressure data measured during the pumps-off period, wherein the first value is identified prior to making a drill pipe connection and the second value is while setting a drill string in slips or while picking up the drill string off slips.

18. The method of claim 16 wherein controlling at least one of drill string hoisting speed, and drill string hoisting acceleration based on the comparison with the first threshold and the second threshold includes:

increasing at least one of drill string hoisting speed, and drill string hoisting acceleration based on the comparison with the first threshold; and decreasing at least one of drill string hoisting speed, and drill string hoisting acceleration based on the comparison with the second threshold.

19. The method of claim 5 wherein the first threshold follows a trend as a function of time, wellbore length, or driller depth.

20. The method of claim 19 wherein the second threshold follows a trend as a function of time, wellbore length, or driller depth.

* * * * *